US006988544B2

(12) United States Patent
Ozaki et al.

(10) Patent No.: US 6,988,544 B2
(45) Date of Patent: Jan. 24, 2006

(54) HEAT EXCHANGER AND METHOD OF MANUFACTURING CORE PLATE

(75) Inventors: Tatsuo Ozaki, Okazaki (JP); Masanobu Toyoda, Obu (JP)

(73) Assignee: DENSO Corporation, Kariya (JP)

( * ) Notice: Subject to any disclaimer, the term of this patent is extended or adjusted under 35 U.S.C. 154(b) by 0 days.

(21) Appl. No.: 10/742,675

(22) Filed: Dec. 19, 2003

(65) Prior Publication Data

US 2005/0051315 A1 Mar. 10, 2005

(30) Foreign Application Priority Data

Dec. 26, 2002 (JP) ..... 2002-376873
Oct. 14, 2003 (JP) ..... 2003-353411

(51) Int. Cl.
*F28F 9/02* (2006.01)

(52) U.S. Cl. ..... 165/173; 165/82; 165/152

(58) Field of Classification Search ..... 165/152, 165/173, 82
See application file for complete search history.

(56) References Cited

U.S. PATENT DOCUMENTS 4,316,503 A * 2/1982 Kurachi et al. ..... 165/175
4,881,594 A * 11/1989 Beamer et al. ..... 165/173
5,311,935 A * 5/1994 Yamamoto et al. ..... 165/152
5,492,172 A 2/1996 Laveran et al.
5,664,625 A * 9/1997 Letrange et al. ..... 165/173
5,816,316 A * 10/1998 Hoffnung ..... 165/76
6,357,521 B1 3/2002 Sugimoto et al.
6,465,113 B2 * 10/2002 Yamada et al. ..... 428/654

FOREIGN PATENT DOCUMENTS

JP 2000-283689 10/2000

* cited by examiner

*Primary Examiner*—Allen J. Flanigan
(74) *Attorney, Agent, or Firm*—Harness, Dickey & Pierce, PLC

(57) ABSTRACT

A wave-shaped portion 5*b*, the profile of which is formed into a wave-shape, is provided on the core plate 5, and tubes are brazed to the core plate 5 under the condition that the tubes are inserted into holes 5*c* formed in bent portions 5*a*. Due to the above structure, even when a pitch between the tubes is reduced, it is possible to ensure a sufficiently high mechanical strength of the core plate 5. Accordingly, the occurrence of a big difference in the mechanical strength between the core plate 5 and the tubes can be suppressed. Therefore, stress concentration at a joint portion of the core plate 5 and the tubes can be prevented. As a result, the mechanical strength of a radiator and the reliability (durability) of the joint portion of the core plate 5 and the tubes can be enhanced.

9 Claims, 7 Drawing Sheets

HEAT EXCHANGER AND METHOD OF MANUFACTURING CORE PLATE

BACKGROUND OF THE INVENTION

1. Field of the Invention

The present invention relates to a heat exchanger. The heat exchanger of the present invention is effectively used when it is applied to a radiator of a water-cooled internal combustion engine in which heat is exchanged between cooling water and air.

2. Description of the Related Art

A conventional radiator includes: a plurality of tubes in which cooling water flows and header tanks, which are arranged on both end sides of the tubes in the longitudinal direction of the tubes and extend in a direction substantially perpendicular to the longitudinal direction of the tubes, communicated with the plurality of tubes. Each header tank includes a core plate into which the tubes are inserted and fixed and a tank portion which, together with the core plate, composes a space in the header tank.

Conventionally, embossed portions, which are respectively formed into a recessed shape or a protruded shape, are provided between holes formed on the core plate into which the tubes are inserted, so that the mechanical strength of the core plate can be enhanced, that is, the deformation strength of the core plate against bending and twisting can be enhanced. This constitution is disclosed, for example, in the official gazette of Japanese Unexamined Patent Publication No. 12-283689.

In this connection, in the radiator described in the official gazette of Japanese Unexamined Patent Publication No. 12-283689, when a pitch between the tubes is decreased so as to reduce the size of the radiator, it becomes impossible to provide embossed portions between the holes into which the tubes are inserted. Alternatively, the size of the embossed portions must be reduced. Accordingly, it is impossible to ensure a sufficiently high mechanical strength.

SUMMARY OF THE INVENTION

The present invention has been accomplished to solve the above problems. It is a first object of the present invention to provide a new heat exchanger different from the conventional heat exchanger. It is a second object of the present invention to provide a heat exchanger having a core plate capable of ensuring a sufficiently high mechanical strength even when a pitch between the tubes is decreased.

In order to accomplish the above objects, according to one aspect of the present invention, a heat exchanger comprises: a plurality of tubes (2) in which fluid flows; and header tanks (4) arranged on both end sides of the tubes (2) in the longitudinal direction, extending in a direction substantially perpendicular to the longitudinal direction of the tubes (2), communicated with the plurality of tubes (2), the header tank (4) including a core plate (5) to which the tubes (2) are fixed and a tank portion (6) composing a space in the header tank (4) together with the core plate (5), the core plate (5) including a wave-shaped portion **(5*b*) having a large number of bent portions (5*a*), formed into a wave-shape proceeding in a direction parallel to the longitudinal direction of the header tank (4), wherein the tubes (2) are inserted into holes (5*c*) formed in the bent portions (5*a*) and fixed to the core plate (5)**.

Due to the foregoing, even when a pitch between the core plate (5) and the tubes (2) is reduced, a sufficiently high mechanical strength can be ensured.

Accordingly, it is possible to prevent a difference of the mechanical strength between the core plate (5) and the tubes (2) from increasing. Therefore, stress concentration upon the joint portion between the core plate (5) and the tubes (2) can be prevented. As a result, it becomes possible to enhance the mechanical strength of the heat exchanger and the reliability (durability) of the joint portion between the core plate (5) and the tubes (2).

According to the present invention, it is preferable that the holes **(5*c*) are provided at top portions of the bent portions (5*a*), which are recessed toward the inside of the header tank (4), in the large number of bent portions (5*a*)**.

Due to the above structure, an oblique face connected to the top portion of the bent portion **(5*a*) can be made to function as a guide face used in the case of inserting the tube (2) into the hole (5*c*). Therefore, the working property can be enhanced when the tubes (2) are inserted and incorporated into the core plate (5)**.

According to the present invention, it is preferable that an entire circumference of the hole **(5*c*) is inclined with respect to the inserting direction of the tube (2) so that the entire circumference of the hole is recessed toward the inside of the header tank (4)**.

Due to the above structure, the working property can be further enhanced when the tubes (2) are inserted and incorporated into the core plate (5).

According to the present invention, the wave-shaped portion **(5*b*) is formed by press forming with a first press-die (100) arranged on one end side in the wall thickness direction, having protrusions protruded toward the other end side in the wall thickness direction, formed into a wave-shape, and with a second press-die (110)** arranged on the other end side in the wall thickness direction, having protrusions protruded toward one end side in the wall thickness direction, formed into a wave-shape.

Due to the foregoing, the recessed and the protruded portions are formed substantially symmetrically with the plate face (reference face) before the formation. Therefore, a direction of the residual stress generated in the process of press forming becomes substantially symmetrical, and the residual stress can be canceled.

Accordingly, it is possible to prevent the core plate (5) from being deformed when the wave-shaped portion **(5*b*) is formed, and deterioration of the manufacturing yield of the core plate (5)** can be prevented.

According to the present invention, it is preferable that a wave-length size ($L_p$) of the wave-shaped portion **(5*b*) is not less than three times and not more than five times of the size of a portion of the tube (2) parallel with the longitudinal direction of the header tank (4)**.

According to the present invention, it is preferable that a ratio ($L_p$/H) of the wave length size ($L_p$) of the wave-shaped portion **(5*b*) to the difference of elevation (H) of the wave-shaped portion (5*b*)** is not less than 0.459 and not more than 0.513.

According to the present invention, it is preferable that thickness (t) of the core plate (5) is substantially 1.5 mm.

Another aspect of the present invention provides a method of manufacturing a core plate (5) used for the heat exchanger (1), comprising the step of press-forming with a first press-die (100), which is arranged on one end side of a plate-shaped member in the wall thickness direction having protrusions protruding to the other end side in the wall thickness direction, and with a second press-die (110) which is arranged on the other end side of the plate-shaped member in the wall thickness direction having protrusions protruding to the one end side in the wall thickness direction.

Due to the foregoing, the recessed and the protruded portions are formed substantially symmetrically with the plate face (reference face) before the formation. Therefore, a direction of the residual stress generated in the process of press forming becomes substantially symmetrical, and the residual stress can be canceled.

Accordingly, it is possible to prevent the core plate (5) from being deformed when the wave-shaped portion (5*b*) is formed, and deterioration of the manufacturing yield of the core plate (5) can be prevented.

The present invention may be more fully understood from the description of preferred embodiments of the invention, as set forth below, together with the accompanying drawings.

DESCRIPTION OF THE PREFERRED EMBODIMENTS (First Embodiment)

Figure 1:
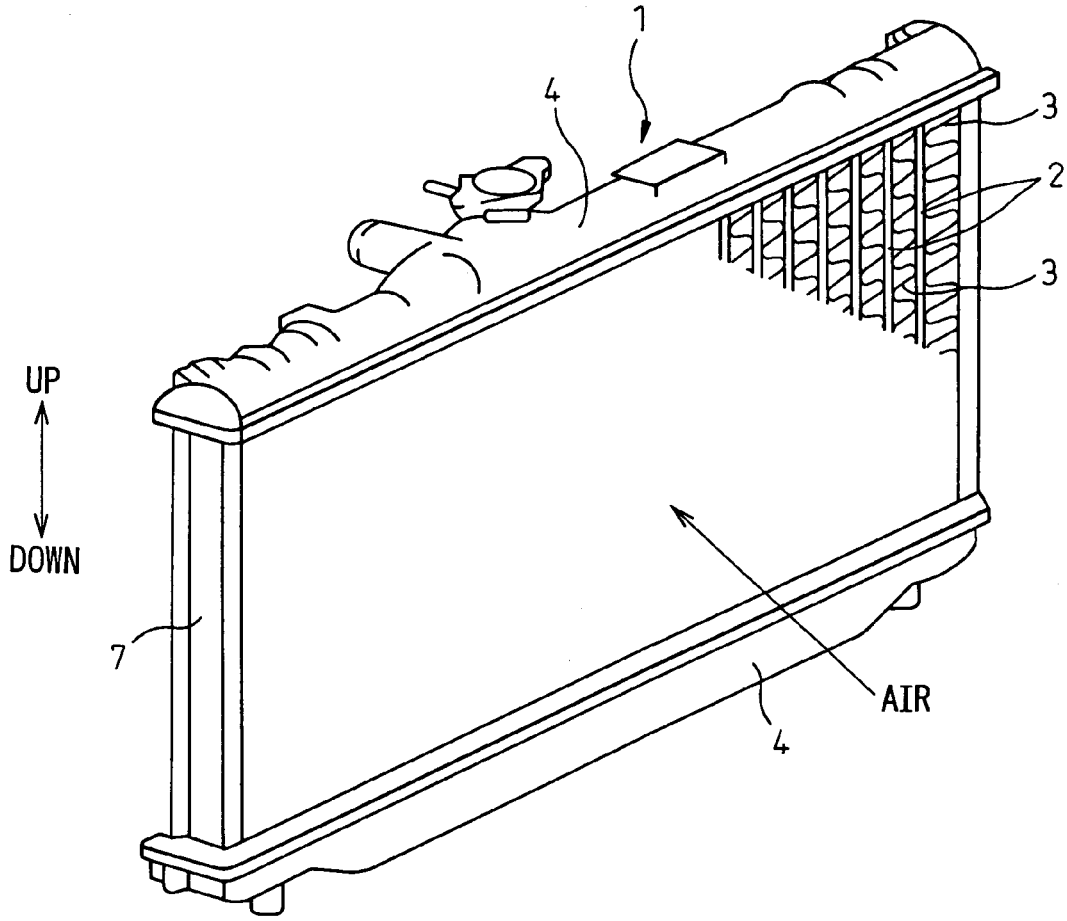
FIG. 1 is a perspective view showing a radiator of the first embodiment of the present invention.
Figure 2:
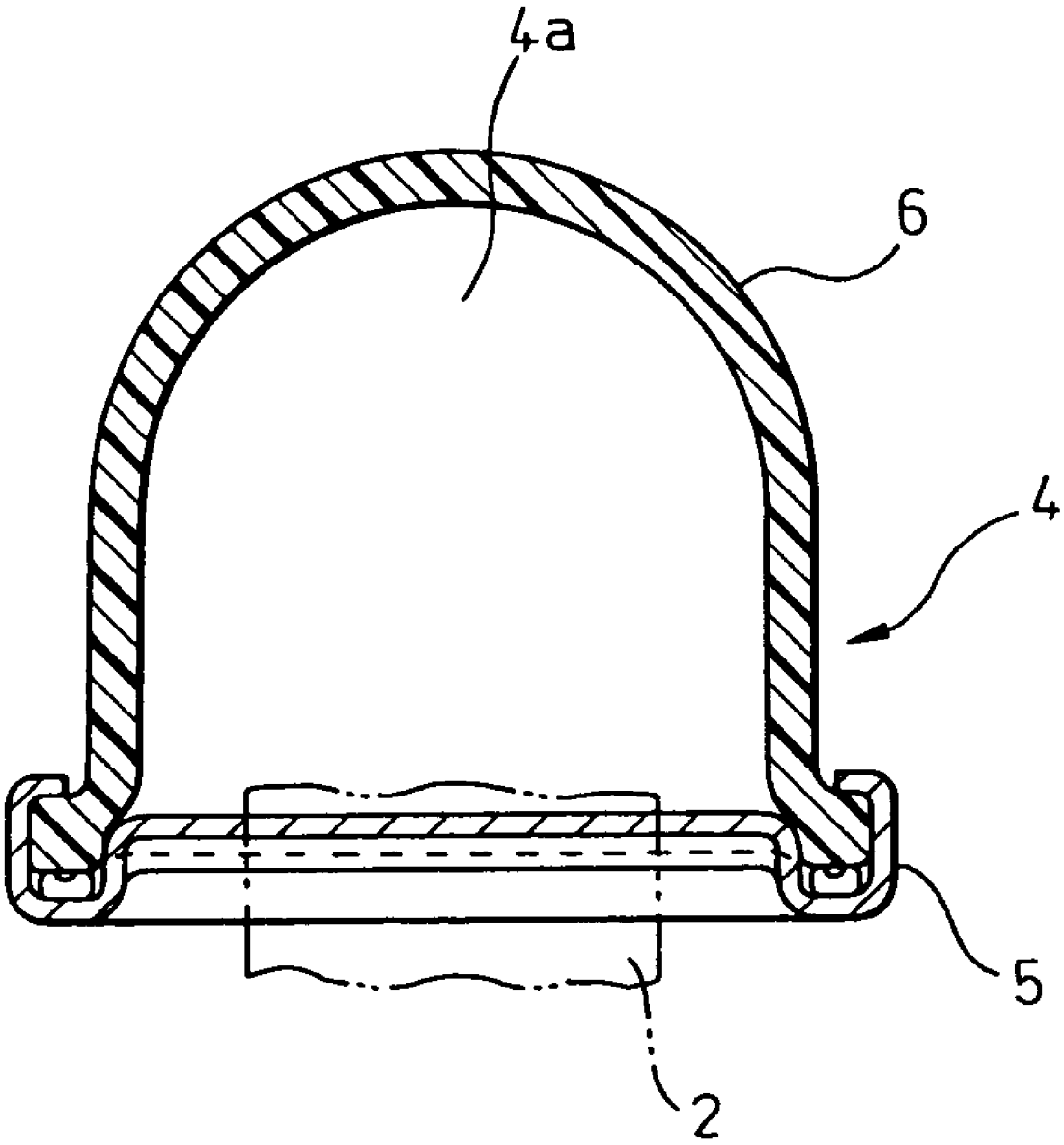
FIG. 2 is a sectional view of a header tank of the first embodiment of the present invention taken on line II—II in FIG. 3A.
Figure 3B:
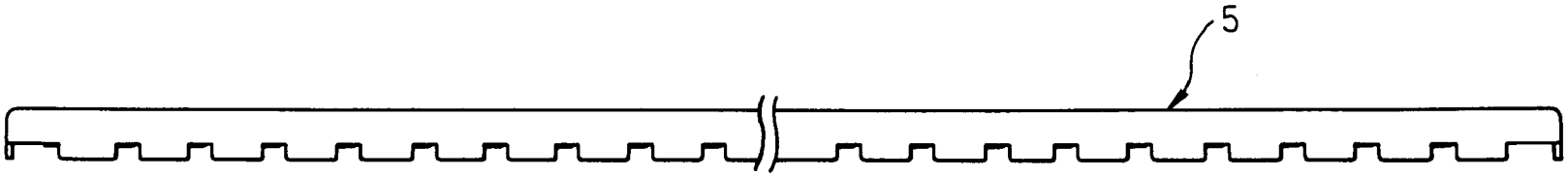
FIGS. 3A and 3B are respectively a plan view and side view showing a core plate of the first embodiment of the present invention.
Figure 3A:
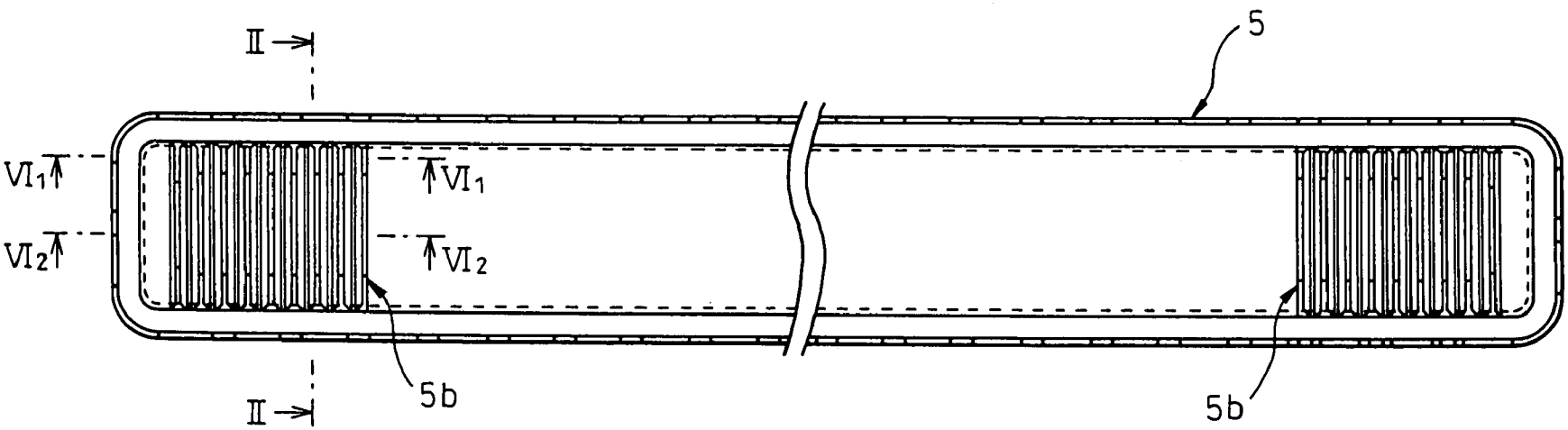
Figure 4:
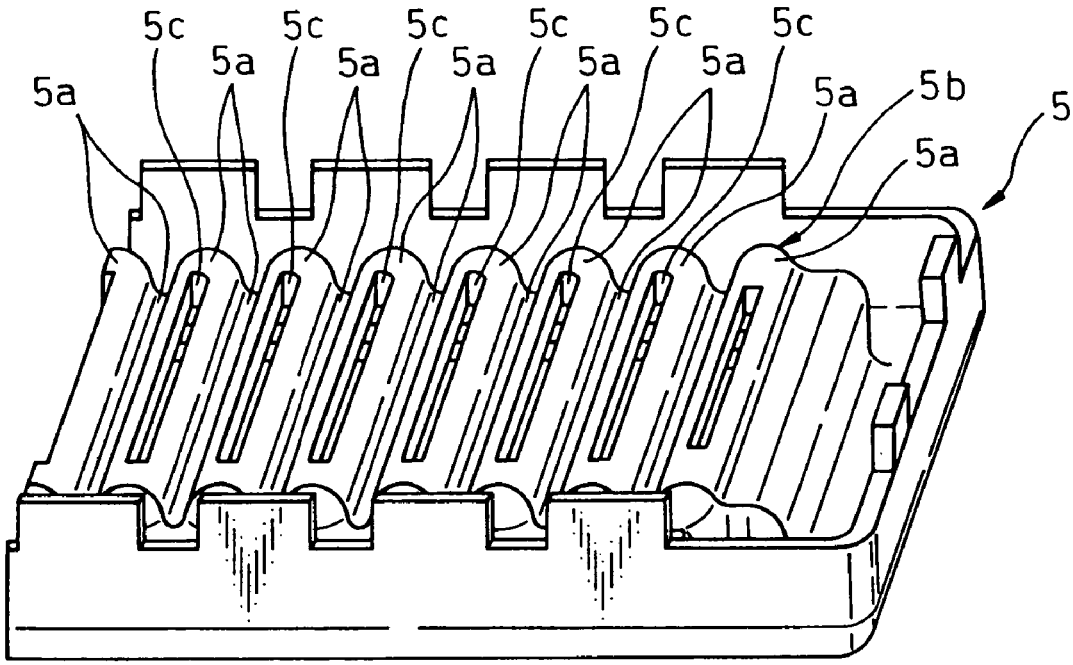
FIG. 4 is a perspective view showing a core plate of the first embodiment of the present invention.
Figure 5:
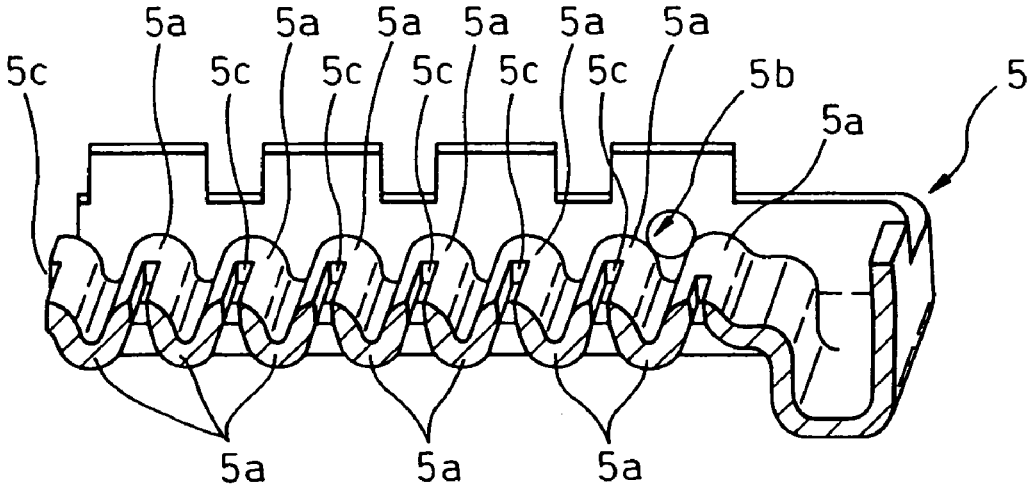
FIG. 5 is a sectional perspective view showing a core plate of the first embodiment of the present invention.
Figure 6A:
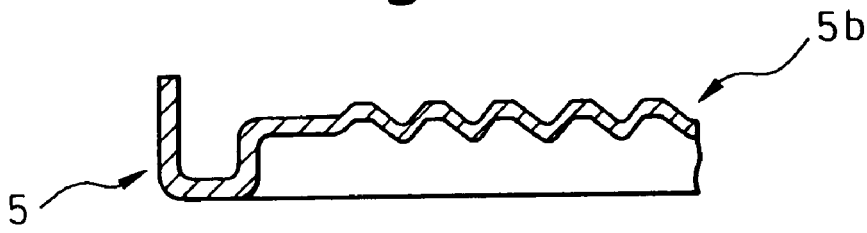
FIG. 6A is a sectional view taken on line $VI_1$—$VI_1$ in FIG. 3A.
Figure 6B:
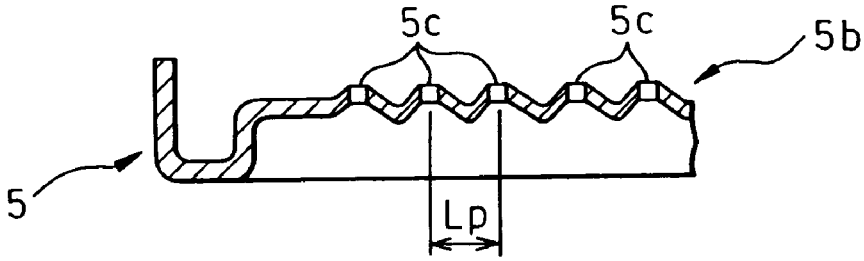
FIG. 6B is a sectional view taken on line $VI_2$—$VI_2$ in FIG. 3A.

In this embodiment, a heat exchanger of the present invention is applied to a radiator for cooling an engine (internal combustion engine) which is a power source to move a vehicle. FIG. 1 is a perspective view of the radiator 1 of the embodiment, FIG. 2 is a sectional view of the header tank, FIG. 3A is a plan view of the core plate, FIG. 3B is a side view of the core plate, FIG. 4 is a perspective view of the core plate, FIG. 5 is a perspective sectional view of the core plate, and FIGS. 6A and 6*b* are sectional views of the core plate.

In FIG. 1, the tube 2 is a flat pipe in which cooling water flows. In this embodiment, the longitudinal direction of the tube 2 coincides with the vertical direction, and the sectional profile of the tube 2 is formed so that the major axis direction can coincide with the air flowing direction. In this connection, the direction of the minor axis of the tube 2 is substantially perpendicular to the air flowing direction. This direction of the minor axis of the tube 2 coincides with the longitudinal direction of the header tank 4 described later.

Wave-shaped fins 3 are provided on the outer surface of the tube 2 so that a heating surface area can be increased and the heat exchange between cooling water and air can be facilitated. In this connection, both the tube 2 and the fins 3 are made of metal (aluminum alloy in this embodiment). Both the tube 2 and the fins 3 are joined to each other by means of brazing, so that the heat exchange core portion can be composed.

For example, as described in "Connecting and Joining Technique" published by Publishing Bureau of Tokyo Denki University, "soldering or brazing" is defined as a technique of joining by using a soft solder or a brazing alloy without melting the mother metal. "Brazing" is defined as a technique of jointing by using a filler metal of which a melting point is not a temperature less than 450° C. and, in this case, the filler metal is called a brazing alloy or a hard solder. "Soldering" is defined as a technique of jointing by using a filler metal of which a melting point is not a temperature more than 450° C. and, in this case, the filler metal is called a soft solder or a low melting solder.

The header tanks 4 compose a tank means provided on both end sides of the tubes 2 in the longitudinal direction. The header tanks 4 extend in a direction substantially perpendicular to the longitudinal direction of the tubes 2 and communicate with the plurality of tubes 2. The header tank 4 arranged on the upper side in the drawing distributes and supplies cooling water into the plurality of tubes 2, and the header tank 4 arranged on the lower side in the drawing collects and recovers cooling water which has flowed out from the tubes 2 after the completion of heat exchange.

As shown in FIG. 2, the header tank 4 includes: a core plate 5 into which the tubes 2 are inserted and fixed; and a tank portion 6 composing the space 4*a* in the header tank 4 together with the core plate 5.

In this embodiment, the core plate 5 is made of metal (aluminum alloy), and the tank portion 6 is made of resin (fiberglass reinforced nylon 66). Under the condition that a packing member, for tight sealing, is interposed between the core plate 5 and the tank 6, one portion of the core plate 5 is plastically deformed by being pressed to the tank portion 6, and the tank portion 6 is calked to the core plate 5.

As shown in FIGS. 4 and 5, the core plate 5 includes a wave-shaped portion 5*b* in which a large number of bent portions 5*a* are provided and formed into a profile of waves proceeding in a direction parallel with the longitudinal direction of the header tank 4. The tubes 2 are inserted into the flat holes 5*c*, which are formed at the top portions of the bent portions 5*a* recessed toward the space 4*a* side in the header tank 4 (the upper side in the drawing), and brazed and fixed to the core plate 5.

In this connection, instead of the tubes 2, the insert plates 7 (shown in FIG. 1) to reinforce the heat exchange core portion are inserted and brazed into the holes 5*c* located on both end sides of the header tanks 4 in the longitudinal direction.

Next, the method of manufacturing the core plate 5 of this embodiment will be explained below.

Figure 7:
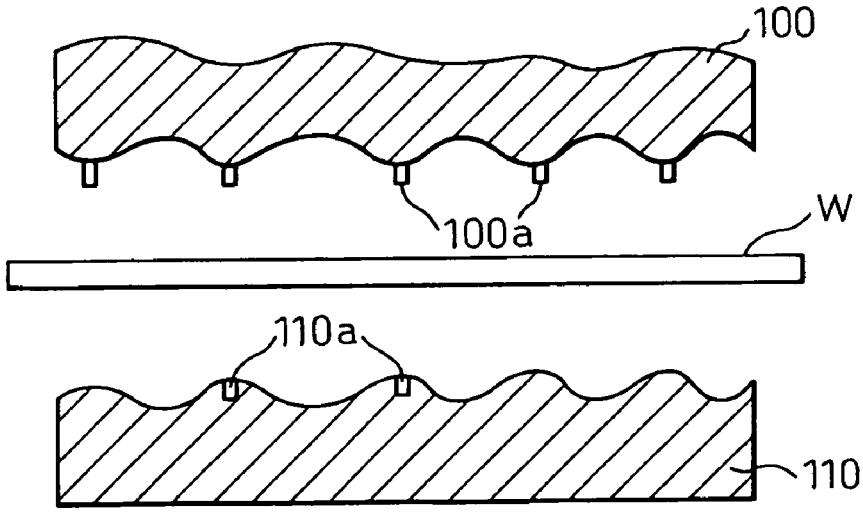
FIG. 7 is a schematic illustration showing a model of a press-forming apparatus relating to the first embodiment of the present invention.

FIG. 7 is a schematic illustration showing a model of the press-forming apparatus for manufacturing the core plate 5. This press-forming apparatus includes: an upper die 100 arranged on one end side of the plate-shaped member W in the thickness direction, having protrusions protruding to the other end side of the plate-shaped member W in the thickness direction, the press-forming face of which is formed into a wave-shape; and a lower die 110 arranged on the other end side of the plate-shaped member W in the thickness direction, having protrusions protruding to one end side of the plate-shaped member W in the thickness direction, the press-forming face of which is formed into a wave-shape. The upper die 100 is moved with respect to the lower die 110, so that the member W is interposed between both the press-forming dies 100 and 110, and formed into a wave-shape. In this embodiment, the convex portions 100*a* are formed at the top portions of the protrusions of the upper die 100, and the concave portions 110*a* are formed at the top portions of the protrusions of the lower die 110, and the holes 5*c* are formed simultaneously with the formation of the wave-shaped portion 5*b*.

Next, the operational effect of the embodiment will be described as follows.

In this embodiment, the wave-shaped portion 5*b*, which is formed into a wave-shape, is provided on the core plate 5, and the tubes 2 are inserted into the holes 5*c* formed in the bent portions 5*a* and brazed to the core plate 5. Therefore, even when the pitch between the tubes on the core plate 5 is reduced, that is, the wave-length $L_p$ of the wave-shaped portion 5*b* is reduced, that is, the pitch between the holes 5*c* (Refer to FIG. 6B.) is reduced, it is possible to ensure a sufficiently high mechanical strength.

Accordingly, the occurrence of a big difference between the mechanical strength of the core plate 5 and that of the tube 2 can be prevented, that is, the occurrence of a big difference between the mechanical strength of the core plate 5 and that of the heat exchange core portion can be prevented. Therefore, it is possible to prevent the occurrence of stress concentration at the joint portion of the core plate 5 and the tube 2. As a result, the mechanical strength of the radiator 1 and the reliability (durability) of the joint portion of the core plate 5 and the tube 2 can be enhanced.

In this embodiment, both the press-forming dies 100 and 110 pinch the member W in the vertical direction so as to form the member W into a wave-shape. Therefore, the recessed portions and protruding portions can be formed substantially symmetrically with respect to the plate face (reference face) before the formation. Therefore, a direction of the residual stress generated in the process of press forming becomes substantially symmetrical, and the residual stress can be canceled to each other.

Accordingly, it is possible to prevent the core plate 5 from being deformed when the wave-shaped portion 5*b* is formed, and deterioration of the manufacturing yield of the core plate 5 can be prevented.

In this embodiment, consideration is given to a reduction in the size of the radiator 1 and an increase in the manufacturing yield, and the wave-length $L_p$ of the wave-shaped portion 5*b* is determined to be not less than three times and not more than 5 times of the thickness (the size in the minor axis direction) of the tube 2, that is, the wave-length $L_p$ of the wave-shaped portion 5*b* is determined to be not less than three times and not more than 5 times of the size of the portion of the tube 2 parallel with the longitudinal direction of the header tank 4.

In this connection, in this embodiment, the wave-length $L_p$ is 7.5 mm, the thickness of the tube 2 is 2 mm, the thickness t of the core plate 5 is 1.5 mm, and the radius of curvature of the inside of the bent portion 5*a* is 0.5 mm.

(Second Embodiment)

Figure 8B:
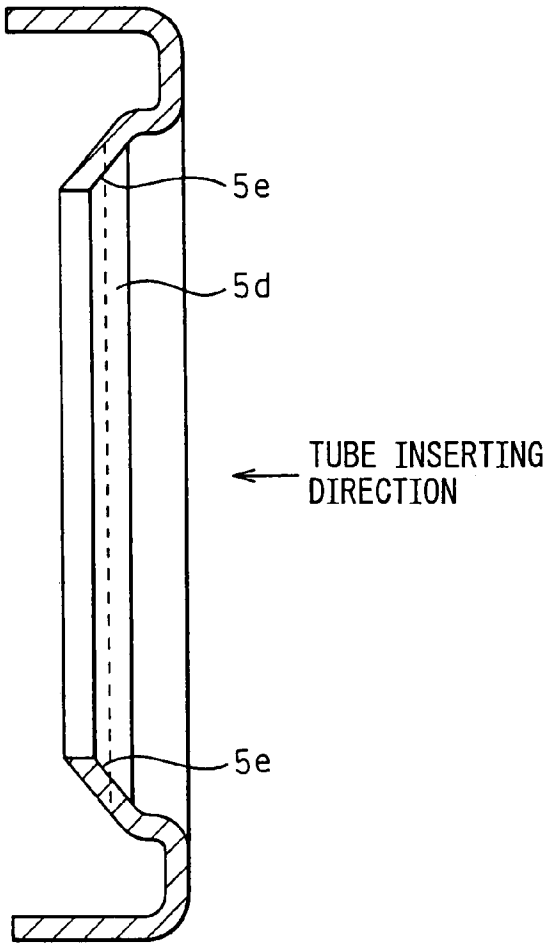
FIG. 8B is a sectional view taken on line VIII—VIII in FIG. 8A.
Figure 8A:
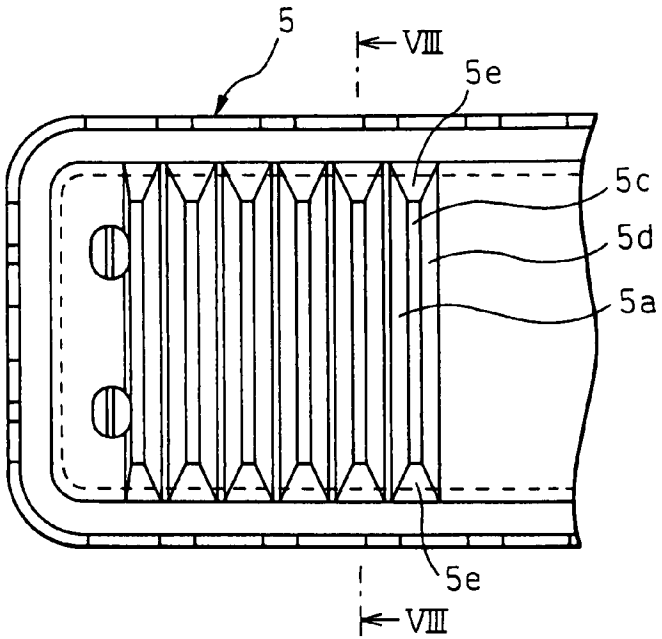
FIG. 8A is a front view showing a core plate of the second embodiment of the present invention.

In the core plate 5 relating to the first embodiment, in the circumference of the hole 5*c* which is formed into a flat shape, only the circumference on the minor axis direction side of the hole 5*c* is inclined with respect to the inserting direction of the tube 2. However, in this embodiment, as shown in FIG. 8, the entire circumference of the hole 5*c* is inclined with respect to the inserting direction of the tube 2.

Due to the foregoing, the oblique face in the entire circumference of the hole 5*c*, that is, the oblique face 5*d* on the minor axis direction side of the hole 5*c* and the oblique face 5*e* on the major axis direction side of the hole 5*c* function as a guide face in the case of inserting the tube 2 into the hole 5*c*.

Accordingly, the working property can be enhanced in the case where the tubes 2 are inserted and incorporated into the core plate 5.

(Third Embodiment)

This embodiment relates to size in the case of obtaining the work limit in the case of forming the core plate 5 into a wave-shape and also obtaining the necessary mechanical strength.

Specifically, a ratio ($L_p$/H) of the wave length size ($L_p$) of the wave-shaped portion 5*b* to the difference of elevation (H) of the wave-shaped portion 5*b* is not less than 0.459 and not more than 0.513.

In this connection, in this embodiment, the core plate 5 is made of aluminum alloy (JIS (Japanese Industry Standard) A3017), and the thickness t is approximately 1.5 mm.

Figure 9:
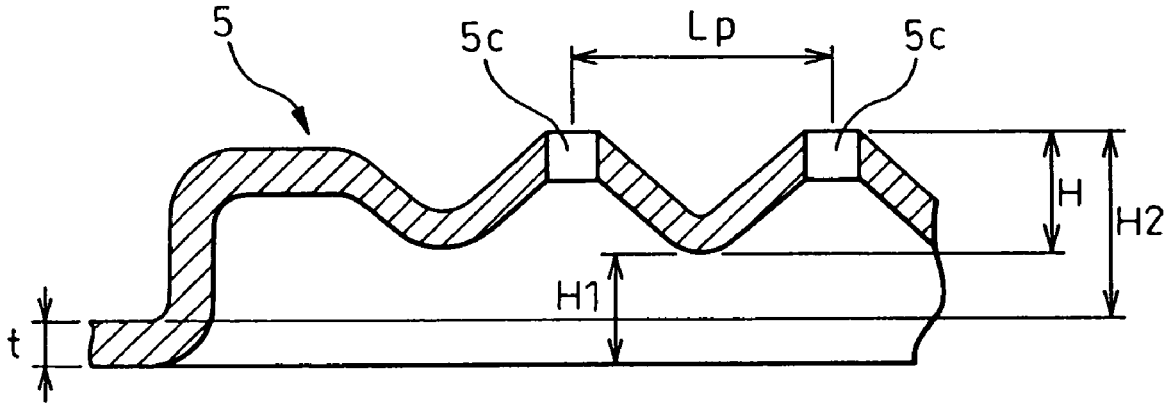
FIG. 9 is a sectional view showing a core plate of the third embodiment of the present invention.

In this connection, in this embodiment, $L_p$ is 8.2 mm, H1 is 3.9 mm, and H2 is 6.1 mm in FIG. 9.

(Fourth Embodiment)

Figure 10:
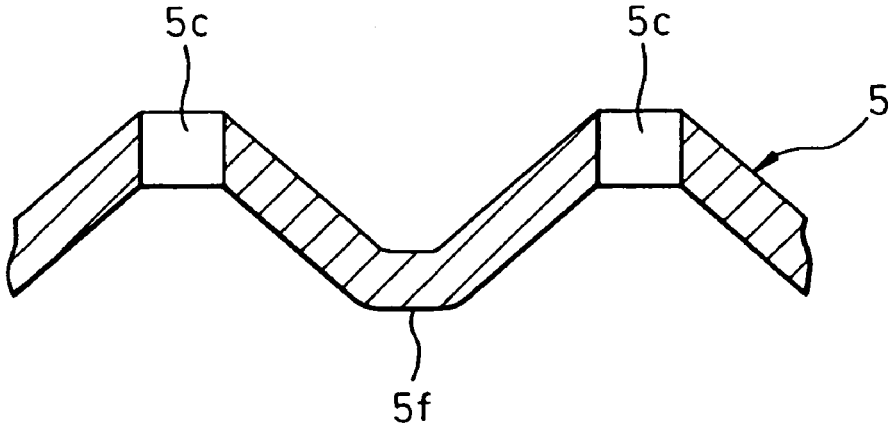
FIG. 10 is a sectional view showing a core plate of the third embodiment of the present invention.

In this embodiment, as shown in FIG. 10, a portion in the top portion of the bent portion 5*a* where the hole 5*c* is not provided is formed into a flat plane so as to provide a plane portion 5*f*.

In the above embodiments, the heat exchanger of the present invention is applied to a radiator used for a water cooling type internal combustion engine. However, it should be noted that the present invention is not limited to the above specific embodiment. For example, the heat exchanger of the present invention may be applied to a radiator used for a fuel cell.

In the above embodiment, the tank portion 6 is made of resin. However, the present invention is not limited to the above specific embodiments. For example, the tank portion 6 may be made of metal.

While the invention has been described by reference to specific embodiments chosen for purposes of illustration, it should be apparent that numerous modifications could be made thereto, by those skilled in the art, without departing from the basic concept and scope of the invention.

What is claimed is:

1. A heat exchanger comprising a plurality of tubes in which fluid flows and header tanks arranged on both end sides of the tubes in a longitudinal direction extending substantially perpendicular to a longitudinal direction of the tubes, communicating with the plurality of tubes, the header tank including: a core plate to which the tubes are fixed; and a tank portion defining a space in the header tank together with the core plate, the core plate including a wave-shaped portion having a plurality of bent portions formed into a wave-shape proceeding in a direction parallel to the longitudinal direction of the header tank, the core plate further including a planar face generally parallel to the longitudinal direction of the header tank, the planar face being located between the wave-shaped portion and an end of the header tank; wherein the tubes are inserted into holes formed in the bent portions and fixed to the core plate.

2. A heat exchanger according to claim 1, wherein the holes are provided at top portions of the bent portions, which are recessed toward the inside of the header tank, in the plurality of bent portions.

3. A heat exchanger according to claim 2, wherein an entire circumference of the hole is inclined with respect to the inserting direction of the tube so that the entire circumference of the hole is recessed toward an inside of the header tank.

4. A heat exchanger according to claim 1, wherein the wave-shaped portion is formed by press forming with a first press-die arranged on one end side in the wall thickness direction, having protrusions protruded toward the other end side in the wall thickness direction, formed into a wave-shape, and with a second press-die arranged on the other end side in the wall thickness direction, having protrusions protruded toward one end side in the wall thickness direction, formed into a wave-shape.

5. A heat exchanger according to claim 1, wherein a wave-length size ($L_p$) of the wave-shaped portion is not less than three times and not more than five times of the size of a portion of the tube parallel with the longitudinal direction of the header tank.

6. A heat exchanger according to claim 1, wherein a ratio ($L_p$/H) of the wave length size ($L_p$) of the wave-shaped portion to the difference of elevation (H) of the wave-shaped portion is not less than 0.459 and not more than 0.513.

7. A heat exchanger according to claim 6, wherein a thickness (t) of the core plate is substantially 1.5 mm.

8. A heat exchanger according to claim 1, wherein the wave-shaped portion is formed by being bent above and below the planar face.

9. A heat exchanger according to claim 1, wherein the planar face is located between the wave-shaped portion and a channel located at the end of the header tank.

* * * * *